US005440851A

United States Patent [19]

Vincenzo

[11] Patent Number: 5,440,851

[45] Date of Patent: Aug. 15, 1995

[54] AUTOMATIC STATION FOR HOUSING BASKETS IN CONTAINERS

[75] Inventor: Pieri Vincenzo, Cesena, Italy

[73] Assignee: Sorma S.r.l., Cesena, Italy

[21] Appl. No.: 221,414

[22] Filed: Mar. 31, 1994

[30] Foreign Application Priority Data

May 5, 1993 [IT] Italy ..... B093A0187

[51] Int. Cl.[6] ..... B65B 1/04; B65B 3/04; B65B 5/00; B65B 39/00

[52] U.S. Cl. ..... 53/244; 53/247; 53/260

[58] Field of Search ..... 53/244, 247, 250, 544, 53/251, 252, 260, 531, 56, 258, 259, 536, 538, 543, 249

[56] References Cited

U.S. PATENT DOCUMENTS

| | | | |
|---|---|---|---|
| 1,954,842 | 4/1934 | Ranney . | |
| 3,097,460 | 7/1963 | O'Brien . | |
| 3,486,292 | 12/1969 | Ninneman | 53/544 |
| 3,710,543 | 1/1973 | Toss | 53/244 |
| 4,045,941 | 9/1977 | Flantua . | |
| 4,081,096 | 3/1978 | Kupcikevicius | 53/259 |
| 4,104,847 | 8/1978 | Glandon et al. | 53/259 |
| 4,237,674 | 12/1980 | Aykut | 53/249 |
| 4,518,160 | 5/1985 | Lambrechts et al. | 53/260 |
| 4,785,611 | 11/1988 | Hasenbalg . | |
| 4,905,456 | 3/1990 | Olaechea | 53/544 |
| 5,121,589 | 6/1992 | Ventura . | |

FOREIGN PATENT DOCUMENTS 2104581 8/1971 France .

*Primary Examiner*—David Jones
*Assistant Examiner*—Rodney Butler
*Attorney, Agent, or Firm*—Dvorak and Traub

[57] ABSTRACT

The station comprises a conveyor belt to bring empty containers to a basket housing station, and for removing the containers when filled, and a conveyor belt for transporting baskets inwardly of the containers; the baskets are housed in an ordered fashion in the containers by a movement device of the baskets inside the containers.

9 Claims, 2 Drawing Sheets

AUTOMATIC STATION FOR HOUSING BASKETS IN CONTAINERS

BACKGROUND OF THE INVENTION

In the packing chain for fruit and vegetable products, one of the last operations consists in filling the packing containers, which will then be dispatched to sales outlets.

Usually cartons or crates used as containers come in standardized sizes and have their edges, at least on the shorter sides, folded inward. Since there exists a relation between carton size and the smaller held container or basket size, a predetermined number of food baskets is housed in each carton.

Since the cartons have folded shorter sides, the baskets are housed in the carton by hand, first by pushing baskets into the edge and corner portion, then by progressively working towards the center of the carton. This takes up valuable time and requires care on the part of the packer so that nothing is damaged and wasted, not least because the baskets are very full with product and must be tightly housed in the carton.

The present invention aims to obviate the above-mentioned drawbacks, by solving the problem of automation in the housing operation of the baskets in the cartons.

SUMMARY OF THE INVENTION

One of the advantages obtained with the present invention is that the packing operation times of the baskets are considerably reduced: the final results are also better in relation to manually packed baskets, since a tighter and more efficient final packing result is obtained.

BRIEF DESCRIPTION OF THE DRAWINGS

Further characteristics and advantages of the present invention will emerge from the detailed description that follows, of an embodiment of the invention, illustrated in the form of a non-limiting example in the accompanying drawings, in which.

DESCRIPTION OF THE PREFERRED EMBODIMENTS

Figure 1:
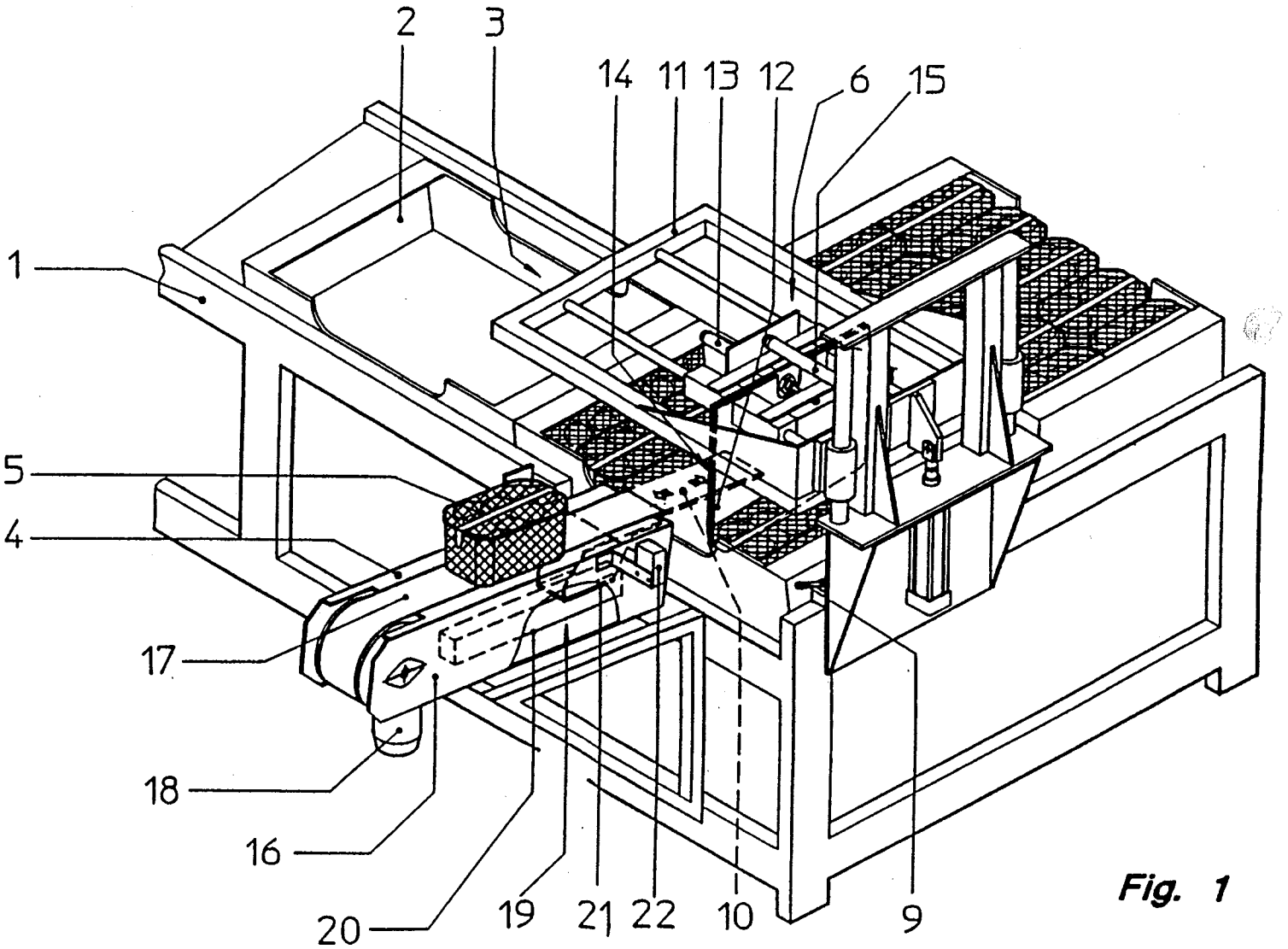
FIG. 1 schematically shows the invention in a frontal perspective view.

As can be seen in the figures, the invention relates to an automatic station 3 for housing food baskets in packing cartons, comprising a package transport device 1 which deposits the empty cartons 2 at a filling position and then removes them once filled. The automatic station 3 further comprises a transport device 4 to place the baskets 5 inside the carton 2, and a basket maneuvering device 6 to locate the baskets 5 in ordered positions in the cartons 2.

Figure 2:
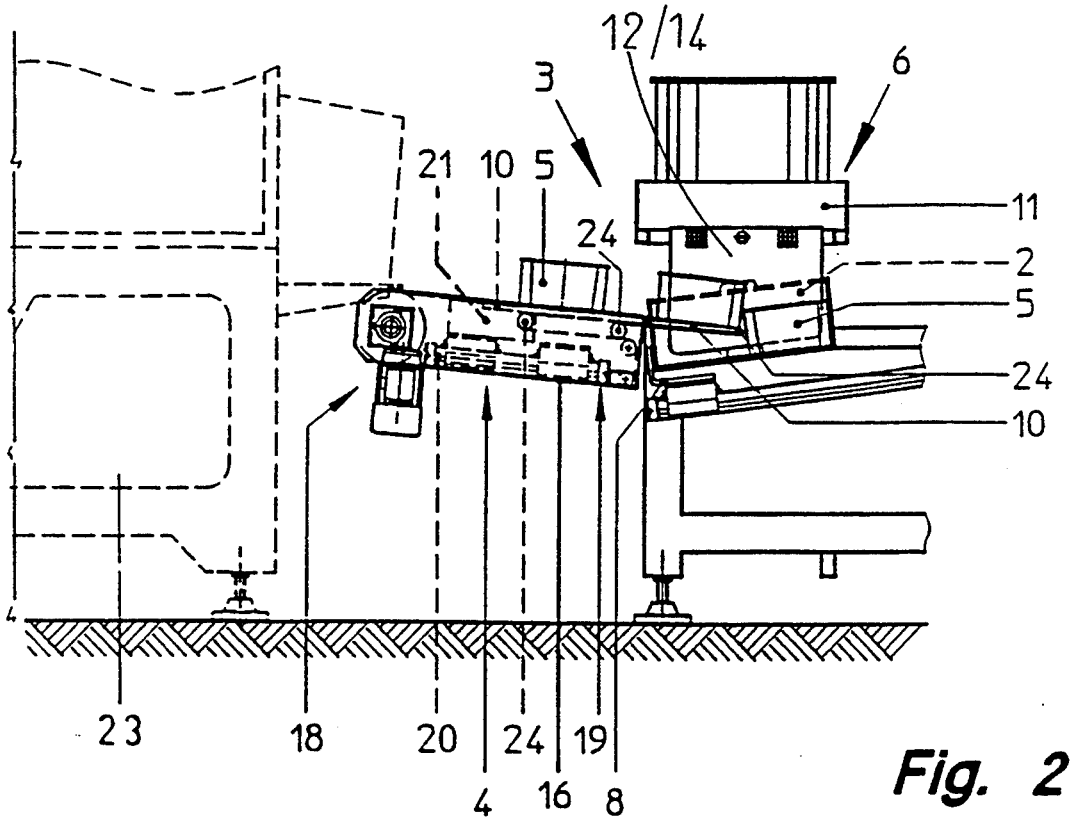
FIG. 2 shows the invention in lateral view.
Figure 3:
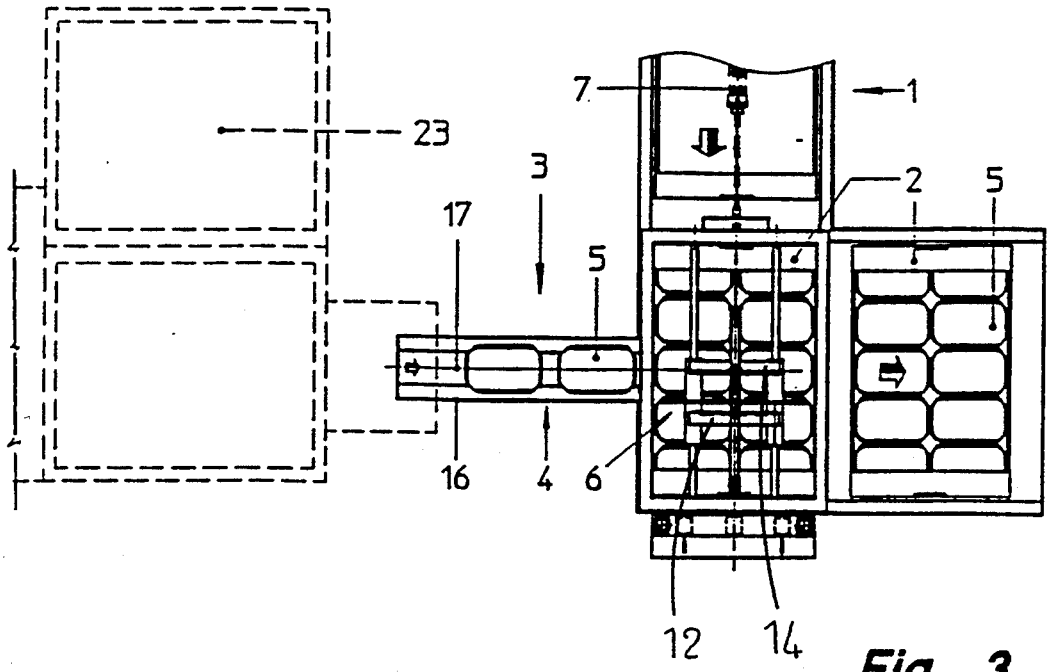
FIG. 3 shows the invention in plan view from above.

The carton 2 transport device 1 comprises a first pusher 7 (see FIG. 3) which nudges an empty carton 2 into a correct filling position, and a second pusher 8 (see FIG. 2) to remove the carton 2 when filled. The two pushers 7 and 8 are activated by means of a first sensor 9, shown in FIG. 1, which signals that a carton 2 has been filled and proceeds to its substitution with a new, empty one.

The basket 5 transport device 4 comprises a principal body 16 and a mobile rigid appendage 10 which, passing from a first completely extended position to a second, complete retracted position, enables the baskets 5 to be positioned inside the canons 2 either on the side of the cartons 2 which is further from the transport device 4, or on the side which is nearer to it.

In the present embodiment, the principal body 16 and the appendage 10 of the transport device 4 are covered by a moving belt 17 connected up to a gear reducer 18. The appendage 10 is independently associated to corresponding means 19 for extending it. The means 19 comprise a mobile and alternating pneumatic cylinder 20 which is attached to a rigid structure 21 also supporting the appendage 10 and comprising at least two rollers 24 for the moving belt 17.

A second sensor 22 controls the movement of the appendage on the basis of the number of baskets 5 that have passed on the appendage 10. After every two baskets 5 have passed, that is after 2, then 4, then 6 etc. have passed, the second sensor 22 stops the gear reducer 18 and a full cycle of the pneumatic cylinder 20 ensues, retracting the appendage 10: the first basket 5 is deposited by action of the moving belt 17, while the second basket 5 drops into the carton 2 by force of gravity on retraction of the appendage 10. Alternatively, the whole transport device 4 could be mobile and alternating such as to deposit the baskets 5 into the carton 2 in the same way as described above. The maneuvering device 6 of the baskets 5 comprises a vertically mobile raised frame 11 provided with at least one transversely mobile fin 12, associated with a pneumatic cylinder 13.

The embodiment shown has, in fact, two transversely mobile fins 12, 14: a first of these is associated to a first pneumatic cylinder 13, which moves it, while a second 14 is associated to a second pneumatic cylinder 15 which moves both the fin 14 and the whole assembly comprising the first fin 12 and the first pneumatic cylinder 13. This embodiment exhibits one considerable advantage, which will emerge from the following description of the whole automatic station 3 functioning.

When a carton 2 is in the ready-for-filling position, the raised frame 11 is lowered, the appendage 10 extended and the motor started: the baskets 5 coming from a packing machine 23 upstream of the automatic station 3 are brought on the moving belt 17 to the inside of the carton 2 and to a zone furthest from the feeding zone. When the second basket 5 has passed the second sensor 22 and locates on the appendage 10, the motor stops, the pneumatic cylinder 20 performs a complete work cycle and the two baskets 5 fall in order, one behind the other: together they are nudged laterally by the two fins 12, 14 operated by the second pneumatic cylinder 15. Since eight baskets 5 are housed in each carton 2, the above operations are repeated until the carton 2 contains eight baskets 5. At this point the first pneumatic cylinder 13 is activated and only the first fin 12 is moved, which pushes the baskets 5, four on each side, and leaves a free space between the first fin 12 and the second fin 14, all of which considerably eases the housing of the last two baskets. Once these last two baskets 5 have been placed, the carton 2 is removed and a new one substitutes it.

I claim:

1. A station for depositing baskets in a carton at a filling station, comprising:

means for transporting a basket to the carton and depositing the basket between a first pair of opposite sides of the canon, the means for transporting a basket having an appendage movable between an extended position and a retracted position, wherein the means for transporting a basket deposits the basket in a first position in the carton when the appendage is in the extended position, and deposits the basket in a second position in the carton, adjacent the first position, when the appendage is in the retracted position; and means for laterally moving the basket in the carton from the first and second positions in the carton to provide space in the first and second positions for another basket, the means for transporting a basket being synchronized in phase with the means for laterally moving the basket.

2. A station as in claim 1, further comprising a first pusher for moving an empty carton into the filling station, and a second pusher for moving the carton from the filling station after it has been filled with baskets, by and a first sensor signalling that the carton at the filling station has been filled with baskets.

3. A station as in claim 1, wherein the appendage extends and retracts from a principal body, and in the extended position deposits a basket into a position at a side of the carton farthest from the principal body, and in the retracted position deposits a basket in a side of the carton nearest to the principal body.

4. A station as in claim 1, wherein the means for laterally moving the basket comprises a vertically mobile frame with a first fin for laterally moving the basket, wherein the first fin is movable by a first pneumatic cylinder.

5. A station as in claim 3, further comprising a belt, coupled to a gear reducer, and movable, by at least two rollers, over and around the principal body and the appendage.

6. A station as in claim 3, further comprising a second sensor to to control extensions and retractions of the appendage based on a number of baskets which have passed on the appendage.

7. A station as in claim 4, wherein the vertically mobile frame includes a second fin, and a second pneumatic cylinder for moving the second fin together with the first fin and the first pneumatic cylinder, wherein the first fin is movable independently of the second fin.

8. A station as in claim 5, further comprising a mobile and alternating pneumatic cylinder for extending the appendage, the mobile and alternating cylinder attached to a rigid structure comprising the at least two rollers for moving the belt.

9. A station for depositing baskets in a carton at a filling station, comprising:

means for transporting a basket to the carton and depositing the basket between a first pair of opposite sides of the carton, the means for transporting a basket movable between an first depositing position and a second depositing position, wherein the means for transporting a basket deposits the basket in a first position in the carton when it is in the first depositing position, and deposits the basket in a second position in the carton, adjacent the first position, when it is in the second depositing position; and means for laterally moving the basket in the carton from the first and second positions in the carton to provide space in the first and second positions for another basket, the means For transporting a basket being synchronized in phase with the means for laterally moving the basket, wherein the means for laterally moving the basket includes a vertically mobile frame with a first fin for laterally moving the basket, wherein the first fin is movable by a first pneumatic cylinder.

* * * * *